US005609122A

United States Patent [19]

Jimmie

[11] Patent Number: 5,609,122

[45] Date of Patent: Mar. 11, 1997

[54] DIVERS SAFETY FLAG

[76] Inventor: Edward J. Jimmie, 524 NE. 5th Ave., Ft. Lauderdale, Fla. 33301

[21] Appl. No.: 572,698

[22] Filed: Dec. 14, 1995

[51] Int. Cl.[6] ..... G09F 17/00

[52] U.S. Cl. ..... 116/173; 116/209; 441/6

[58] Field of Search ..... 116/173, 209, 116/26, 28 R; 40/218, 219

[56] References Cited

U.S. PATENT DOCUMENTS

| | | | |
|---|---|---|---|
| 3,105,459 | 10/1963 | Conn . | |
| 3,149,352 | 9/1964 | Christiansen . | |
| 3,280,789 | 10/1966 | Lewis . | |
| 3,636,912 | 1/1972 | Kamp | 116/173 |
| 3,640,242 | 2/1972 | Guinn . | |
| 4,144,606 | 3/1979 | McIntyre | 441/11 |
| 4,599,965 | 7/1986 | Johnson . | |
| 4,633,215 | 12/1986 | Anders . | |
| 4,781,636 | 11/1988 | Schurr | 441/6 |
| 4,796,553 | 1/1989 | Cogswell . | |
| 4,807,557 | 2/1989 | Lodisio . | |
| 4,962,720 | 10/1990 | Leffel . | |
| 5,024,179 | 6/1991 | Leffel . | |
| 5,179,907 | 1/1993 | Galbraith | 116/173 |
| 5,256,490 | 10/1993 | Pierce | 116/173 |
| 5,450,811 | 9/1995 | Heiland . | |

*Primary Examiner*—William A. Cuchlinski, Jr.
*Assistant Examiner*—Vagnola Khamvongsa
*Attorney, Agent, or Firm*—Charles J. Prescott

[57] ABSTRACT

A storable diver's flag which is visible in substantially all directions. The flag includes three flexible rectangular panels connected to one another along a common central seam between the panels. The panels are thus radially extendable to an in-use position from the central seam at generally equal radial angles between adjacent panels whereby diver down indicia on both surfaces of the panels allow the upright in-use flag and indicia to be seen from any direction. Wire support members extending diagonally across each panel keeps the panels extended and upstanding in use. Two equal length wire braces each of which extend between adjacent panels in close proximity to the central seam urge the panels into the in-use position.

7 Claims, 2 Drawing Sheets

DIVERS SAFETY FLAG

BACKGROUND OF THE INVENTION

1. Scope of Invention

This invention relates generally to signal flag devices such as dive flags, and more particularly to a storable diver's flag which is viewable from all directions.

2. Prior Art

The use and general configuration of diver's flags having diver down indicia printed thereon is well known. These flags are generally rectangular in shape having each surface containing a red overall background and a broad diagonal white stripe passing centrally between opposing corners. This flag and viewable indicia is easily recognizable from afar when the flag is oriented at an acute or orthogonal orientation to the viewer. Various viewable signal flags and other such signal devices are known to applicant and are disclosed in the following prior U.S. patents:

| | |
|---|---|
| 3,105,459 | Conn |
| 3,149,352 | Christiansen |
| 3,280,789 | Lewis, et al. |
| 3,640,242 | Guinn, et al. |
| 4,599,965 | Johnson |
| 4,633,215 | Anders, et al. |
| 4,796,553 | Cogswell, et al. |
| 4,807,557 | Lodisio |
| 4,962,720 | Leffel |
| 5,024,179 | Leffel |
| 5,450,811 | Heiland |

Because all of these prior art devices include a generally planar flag or panel when outstretched with the viewable indicia printed on one or both sides thereof, should the flag have a generally edgewise orientation with respect to the viewer, the flag will not be seen. Of course, if wind or support member orientation is such that the flag is extended generally transversely or orthogonally with respect to the line of sight, the flag would be easily viewable.

The present invention overcomes this limitation of limited flag viewability by providing a multi-panel diver's flag comprising at least three rectangular panels oriented at equal radial angles one to another of approximately 120° so that the diagonal white stripe or diver down indicia printed on both sides of each panel is easily viewable from any direction. A wire support member is connected and diagonally extends across each of the panels, maintaining them in a fully extended and outstretched orientation for consistent viewability. Other wire bracing means in close proximity to the common central seam between the three panels urges the panels into an equal angular orientation one to another.

BRIEF SUMMARY OF THE INVENTION

This invention is directed to a storable diver's flag which is visible in substantially all directions. The flag includes three flexible rectangular panels connected to one another along a common central seam between the panels. The panels are thus radially extendable to an in-use position from the central seam at generally equal radial angles between adjacent panels whereby diver down indicia on both surfaces of the panels allow the upright in-use flag and indicia to be seen from any direction. Wire support members extending diagonally across each panel keeps the panels extended and upstanding in use. Two equal length wire braces each of which extend between adjacent panels in close proximity to the central seam urge the panels into the in-use position.

It is therefore an object of this invention to provide a diver's flag having diver down printed indicia thereon which is easily viewable from any direction when the flag is in its upright in-use orientation.

It is yet another object of this invention to provide an easily storable diver's flag having more than two panels bearing diver down indicia thereon oriented at equal angles one to another about an upright central seam.

It is still another object of this invention to provide a storable diver's flag which includes diagonal wire support means associated with each of its three panels to maintain includes diagonal wire support means associated with each of its three panels to maintain the panels in an extended outstanding configuration.

In accordance with these and other objects which will become apparent hereinafter, the instant invention will now be described with reference to the accompanying drawings.

DETAILED DESCRIPTION OF THE INVENTION

Figure 1:
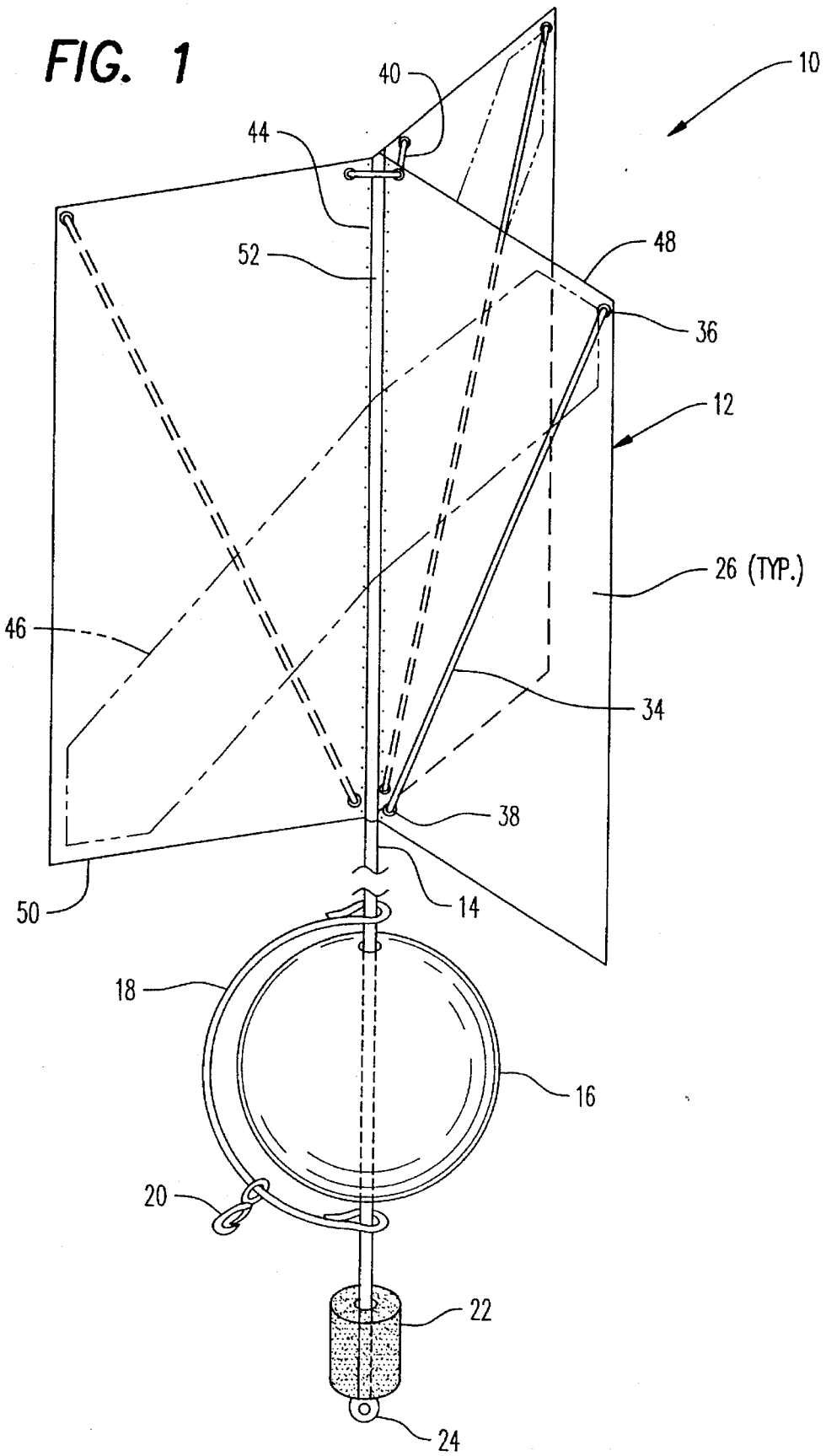
FIG. 1 is a perspective view of the invention.

Referring now to the drawings, the invention is shown generally at numeral 10 and includes a multi-panel diver's flag assembly 12, an elongated slender, straight mast 14, a spherical float member 16 for buoyancy and a counterweight 22 for maintaining an upright orientation of the device 10 when afloat in a body of water.

It should, be understood that, although the preferred embodiment 10 is shown in FIG. 1 to include a float member 16, nonetheless the invention in the form of the flag assembly 12 may be used in conjunction with a fixed mast connected to a boat or other stationary object and like members and be within the intended scope of this invention.

Figure 2:
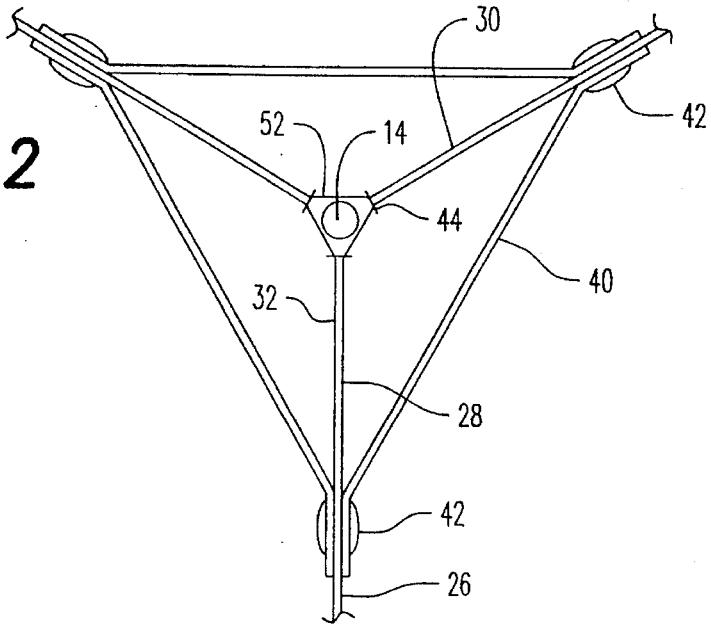
FIG. 2 is an end view of the central portion of the diver's flag of FIG. 1.
Figure 3:
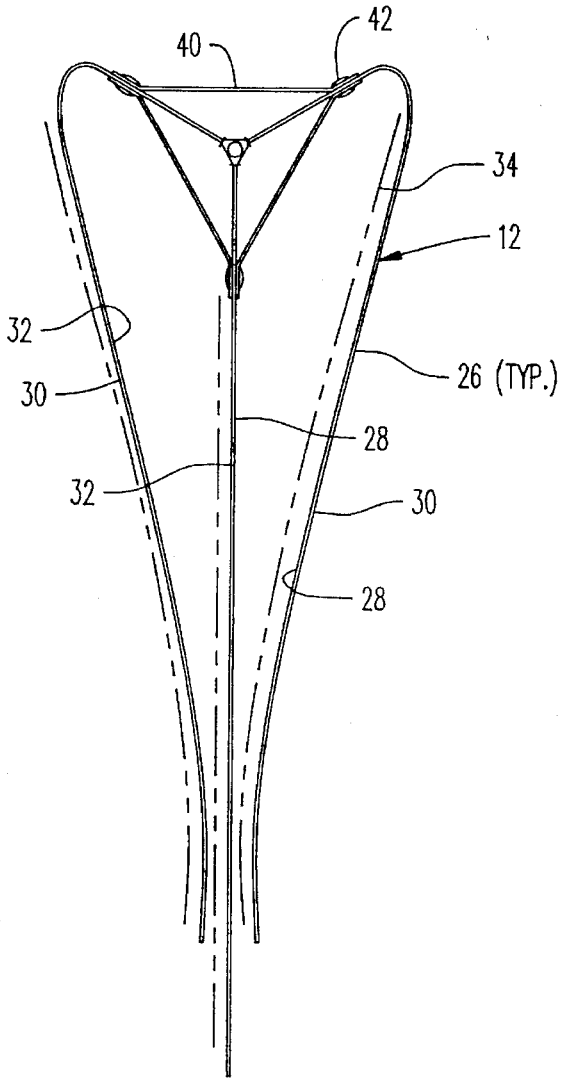
FIG. 3 is a view similar to FIG. 2 showing the panels in a folded orientation for storage.

The flag assembly 12 includes three flexible rectangular panels shown typically at 26, As best seen in FIGS. 2 and 3, these panels 26 are formed of three larger rectangular sheets 28, 30 and 32 made of flexible, water-resistant or water-repellant material such as stiff or semi-stiff rubberized or plasticized or laminated nylon-reinforced vinyl. These flexible sheets 28, 30 and 32 are substantially twice the width of each panel 26 and become the panels 26 when joined together by stitching at 44 (typ.) and by then joining together each mating pair of six half portions o fhte flexible sheets 28, 30 and 32. By spacing each stitching 44 very slightly apart, an elongated pocket or cavity 52 is formed which is generally triangular in cross section for receiving the mast 14 as best seen in FIGS. 1 and 2.

Each of the panels 26 is supported and maintained in an extended, outstanding orientation by elongated slender wire members 34 (typ.), one for each panel, fabricated of either rigid or semi-rigid corrosive resistant wire material. Each end of the wire support 34 is connected as by riveting to the outer upper corner at 36 and to the lower inner corner at 38 of each panel 26. Thus, each wire support 34 extends diagonally across each panel 26 as seen in FIG. 1. Additional upright support is provided by having the mast 14 extend fully along the length of the triangular pocket 52, the upper end of which is sealed to define a stop for the upper end of the mast 14.

A spherical buoyancy member 16 connected onto the mast 14 is also provided in the preferred embodiment 10 to support the device afloat in a body of water. A flexible arcuate wire 18 pivotally connected at each end to the mast 14 directly above and below the buoyancy member 16 and having a loosely fitting snap shackle 20 connected thereto provides a quick means for the detachable connection of various diving lines and gear normally associated with snorkeling, free diving and SCUBA diving. A counterbalance 22 maintains the device 10 in its upright orientation, while eyelet 24 may be attached to an anchor line for stationary positioning above the bed of the water.

With the majority of both surfaces of the panel 26 being red, a white diagonal stripe shown in phantom at 46 is applied from the lower corner 50 (typ.) of one panel to the upper corner 48 (typ.) of the next adjacent panel. This arrangement and configuration of the diagonal white diver down stripe 46 provides additional width and length for heightened viewability by being extended over two rectangular surfaces of adjacent panels 26.

To maintain the panels 26 is a generally equilateral orientation one to another as shown, at least two wire braces 40 (typ.) are connected at each end by rivets 42 between adjacent panels as best seen in FIG. 2 in close proximity to the central seam 44. Three wire braces 40 of equal length and connected as in FIG. 2 are preferred. By equal sizing in length and positioning in close proximity to the central seam 44 of these braces 40, the panels 26 are urged into an equal lateral radial orientation one to another of approximately 120° so that the diver down indicia 46 in three positions on the diver's flag assembly 12 on surfaces of each set of two adjacent panels 26 is viewable from virtually any generally horizontal direction when the flag assembly 26 is in its generally upright orientation as shown in FIG. 1.

FIG. 3 depicts the storeability of the flag assembly 12. The sheet material 28, 30 and 32 previously described is of a relatively stiff nature, especially when double layered together as shown. Thus, as urged by wire braces 40 previously described, a general equal lateral orientation is maintained. Coupled with the wire support members 34, the in-use orientation best seen in FIG. 1 is generally maintained.

However, for storage, two of the three panels 26 may be flexed or laid against the third panel as in FIG. 3 without deforming either support wires 34 or wire bracing 40. Thus, the overall stored size is generally equal to the rectangular dimensions of one panel 26. Further compacting of the diver flag assembly 12 is achieved by rolling of the arrangement shown in FIG. 3 about the length of support wires 34 (not shown).

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A storable multi-panel diver's safety flag and mast in combination comprising:

three flexible rectangular shaped panels formed of three sheets of flexible material having a width substantially twice that of each said panel, said sheets connected together along a common central portion of each said sheet to define a central elongated pocket or cavity and three mating pairs of connected sheet haft portions, each said pair becoming one said panel, said panels being extendable radially from said pocket or cavity in spaced angular orientation one to another;

an elongated mast connectable within and extending in one direction from said pocket or cavity;

each said panel including a rigid or semi-rigid elongated slender support connected at each end thereof to, and extending between, an outer upper corner and a lower inner corner of each said panel whereby each said panel is generally straight and upstanding;

angular orientation means for maintaining said panels in the angular orientation;

diver down indicia on each said sheet viewable in any generally horizontal direction from said panels when in use.

2. A diver's safety flag as set forth in claim 1, wherein:

said panels are flexibly foldable against one another, facilitated by resilient bending of each said support, for storage.

3. A diver's safety flag as set forth in claim 2, further comprising:

means connected to said mast for buoyantly supporting said safety flag above the water in a generally upright orientation of said mast.

4. A diver's safety flag as set forth in claim 3, further comprising:

means pivotable about said mast and around said buoyant support means for detachably connecting one end of a line thereto.

5. A diver's safety flag as set forth in claim 1, wherein said angular orientation means includes:

a wire brace connected and laterally extending between adjacent said panels in close proximity to said central portion.

6. A diver's safety flag as set forth in claim 5, wherein:

said panels flexibly foldable against one another for storage by folding two said panels about said central portion substantially against a third said panel without substantial deformation or removal of said supports or said angular orientation.

7. A diver's safety flag comprising:

three flexible rectangular shaped panels extending radially from a common central elongated pocket or cavity in spaced angular orientation one to another;

an elongated slender mast connectable to, and extending in one direction from, said central pocket or cavity;

each said panel including a rigid or semi-rigid elongated slender were member connected at each end thereof to, and extending between, an outer upper corner and a lower inner corner of each said panel whereby each said panel is generally straight and upstanding when in use;

a wire brace connected and laterally extending between adjacent said panels in close proximity to said central portion for maintaining a substantially evenly spaced angular orientation of said panels;

diver down indicia on each said sheet viewable in any generally horizontal direction from said panels when said mast is upright.

* * * * *